US007093711B2

(12) United States Patent
Draghetti et al.

(10) Patent No.: US 7,093,711 B2
(45) Date of Patent: Aug. 22, 2006

(54) PACKAGE OF TOBACCO ARTICLES FEATURING A SHOPLIFTING MARKER

(75) Inventors: Fiorenzo Draghetti, Medicina (IT); Alessandro Minarelli, Bazzano (IT); Gaetano De Pietra, Casalecchio Di Reno (IT); Luca Cerati, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 219 days.

(21) Appl. No.: 10/720,407

(22) Filed: Nov. 24, 2003

(65) Prior Publication Data

US 2004/0149602 A1 Aug. 5, 2004

(30) Foreign Application Priority Data

Nov. 25, 2002 (IT) ..... BO2002A0741

(51) Int. Cl.
*B65D 85/10* (2006.01)

(52) U.S. Cl. ..... 206/268; 206/273; 206/807

(58) Field of Classification Search ..... 206/242, 206/247, 265, 268, 271, 273, 807; 229/160.1; 340/572.1, 568.1, 572.2
See application file for complete search history.

(56) References Cited

U.S. PATENT DOCUMENTS 3,938,125 A 2/1976 Benassi
5,586,648 A * 12/1996 Focke et al. ..... 206/268
5,823,350 A * 10/1998 Ward ..... 340/572.1
5,871,100 A * 2/1999 Ward ..... 206/807
6,021,893 A * 2/2000 Boriani et al. ..... 206/273
6,216,860 B1 * 4/2001 Boriani et al. ..... 206/268
6,591,981 B1 * 7/2003 Draghetti ..... 206/268
2002/0047107 A1 4/2002 Lindstrom et al.

FOREIGN PATENT DOCUMENTS

EP 0 673 007 9/1995
EP 0 967 161 12/1999
EP 1 236 650 9/2002

* cited by examiner

*Primary Examiner*—Luan K. Bui
(74) *Attorney, Agent, or Firm*—Marshall, Gerstein & Borun LLP

(57) ABSTRACT

A package of tobacco articles, having a container; a group of tobacco articles housed inside the container; and a marker, which is housed inside the container, has a resonating body resonating at a given resonance frequency, and is remotely detectable by a shoplifting detector device by means of an electromagnetic field having a frequency substantially equal to the resonance frequency.

10 Claims, 3 Drawing Sheets

PACKAGE OF TOBACCO ARTICLES FEATURING A SHOPLIFTING MARKER

CROSS-REFERENCE TO RELATED APPLICATION

This application claims the benefit of Italian Patent Application Serial No. BO2002A 000741 filed Nov. 25, 2002.

The present invention relates to a package of tobacco articles.

BACKGROUND OF THE INVENTION

In the following description, reference is made to packets of cigarettes for the sake of simplicity and purely by way of example.

As described in Patent Applications EP 0967161, EP 1248737, EP 1250272, EP 1255676 and EP 1255684, packets of cigarettes have been proposed incorporating, internally or externally, a magnetic strip containing information relative to the history and/or characteristics of the packet, and which is typically glued either to the transparent plastic overwrapping or to an inner or outer wall of the packet of cigarettes. In actual use, the data stored on the magnetic strip is read and possibly modified by a communication device, by placing the packet with the magnetic strip facing and substantially contacting a read surface of the communication device, and is typically used in lieu of a bar code to automatically identify the packet of cigarettes, or for storing the "history" of each packet inside, or to prevent imitation by unequivocally determining the provenance of the packet (in which case, the data stored in the packet must obviously be encrypted).

Packets of cigarettes are now sold widely in self-service outlets, i.e. in which the packet is removed by the consumer off a freely accessible shelf and paid for at a check-out counter at the exit. Since such outlets have been found to be particularly prone to shoplifting of packets of cigarettes, by both habitual shoplifters and consumers (typically minors) not allowed to purchase packets of cigarettes, attempts have been made to use the magnetic strip on each packet of cigarettes as a shoplifting detector. So far, however, these have been substantially unsuccessful, on account of the magnetic strip on the packet only being readable within a range of 5–10 centimeters from the communication device, and being made ineffective, i.e. non-detectable, by wrapping the packet in a conducting metal element, e.g. aluminium foil, to shield the electric field.

US2002047107 discloses a product package incorporating a product sensor with at least two conductive layers and at least one insulating layer formed in between them; the conductive layers and insulating layer are made by printing, preferably by serigraphy, and using for the conductive layers a conductive ink.

EP1236650 discloses a paperboard packaging, such as trays, lids, cartons containers, having a disposable RF-EAS security tag integrated in the paperboard.

EP0673007A discloses an article incorporating an electromagnetic sensor material whose presence can be detected; tags are cut from the tagging material as the tagging material and articles are conveyed along converging paths and are adhered to the articles by the adhesive of a pressure sensitive adhesive tape connected to the tags.

SUMMARY OF THE INVENTION

It is an object of the present invention to provide a package of tobacco articles, designed to eliminate the aforementioned drawbacks, and which at the same time is cheap and easy to produce.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
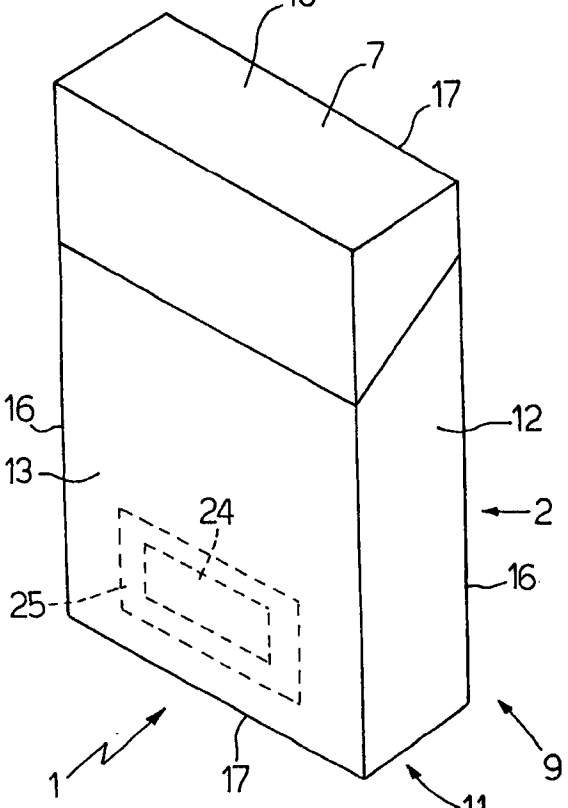
FIG. 1 shows a front view in perspective of a packet of cigarettes in accordance with the present invention and in the closed configuration.

Number 1 in FIG. 1 indicates as a whole a rigid packet of cigarettes comprising a cup-shaped container 2; and a parallelepiped-shaped group 3 of cigarettes 4, which is wrapped in a sheet 5 of foil wrapping material and housed inside container 2. Container 2 comprises an open top end 6; and a cup-shaped lid 7 hinged to container 2 along a hinge 8 to rotate, with respect to container 2, between an open position (FIG. 2) and a closed position (FIGS. 1 and 3) respectively opening and closing open top end 6.

In the closed position, lid 7 imparts to container 2 a substantially rectangular parallelepiped shape defined by a lateral surface 9, and by two flat, identical, respectively top and bottom end walls 10 and 11 facing and parallel to each other and bounding lateral surface 9.

Lateral surface 9 comprises two facing, parallel, flat minor lateral walls 12, and two facing, flat major lateral walls 13 and 14 crosswise to minor lateral walls 12. More specifically, one major lateral wall 13 defines a front wall of container 2, and the other major lateral wall 14 defines a rear wall of container 2.

Packet 1 also comprises a collar 15, which is folded into a U and connected (glued) inside container 2, so as to project partly outwards of open top end 6 and engage a corresponding inner surface of lid 7 when lid 7 is in the closed position (FIG. 1).

Four longitudinal edges 16 are defined between minor lateral walls 12 and major lateral walls 13 and 14; and eight transverse edges 17 are defined between end walls 10 and 11 and lateral walls 12, 13 and 14.

Figure 4:
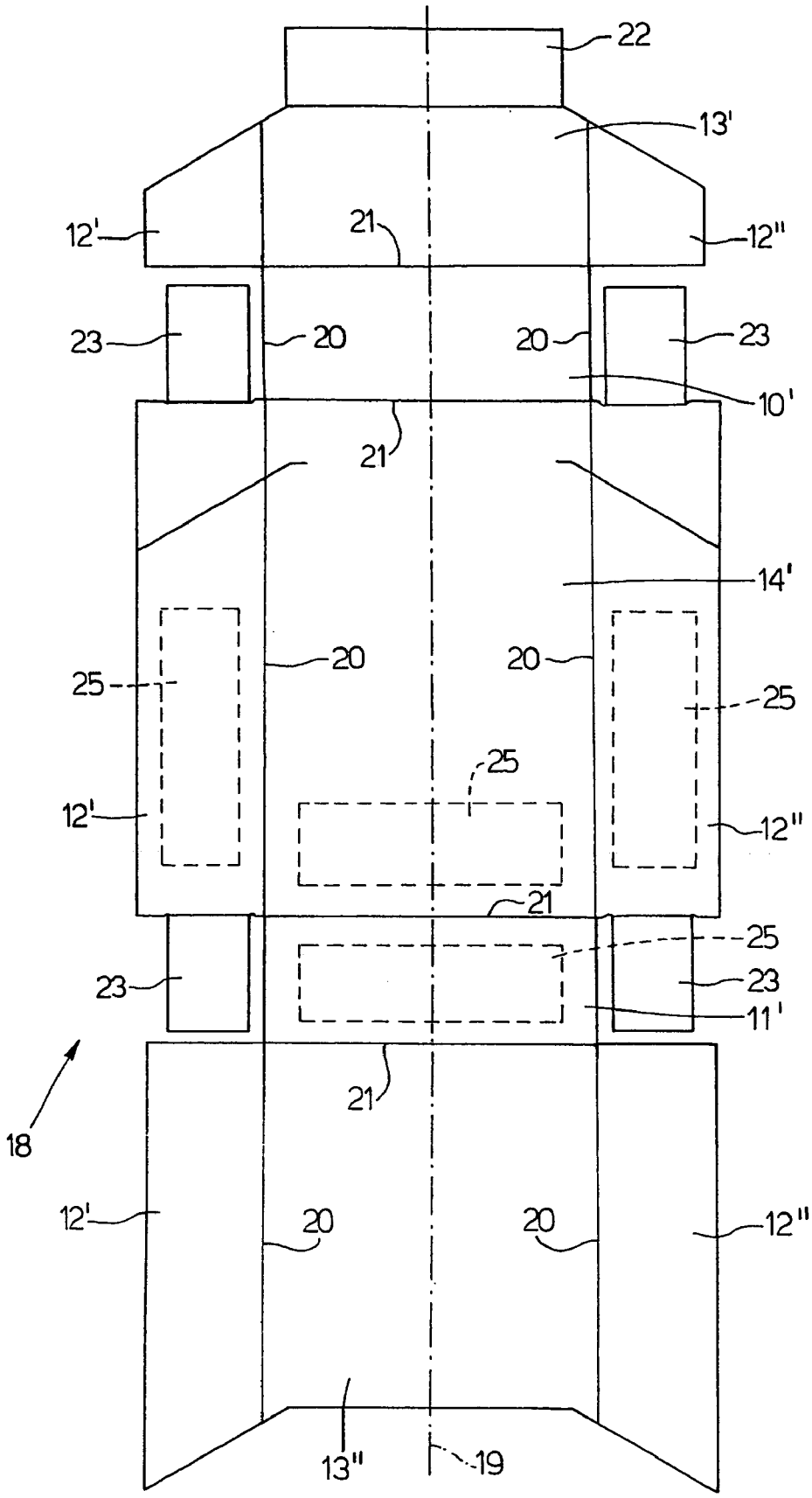
FIG. 4 shows a plan view of a blank from which to produce the FIG. 1 packet.

As shown in FIG. 4, container 2 is formed from a corresponding flat blank 18, which is substantially in the form of an elongated rectangle, and the component parts of which are indicated, when possible, using the same reference numbers, with superscripts, as for the corresponding parts of container 2.

Blank 18 (having a longitudinal centreline 19) comprises two longitudinal crease lines 20, and a number of transverse crease lines 21 defining, between the two longitudinal crease lines 20, a panel 13' defining a top portion of front wall 13 (in particular, the portion forming part of lid 7); a panel 10' defining top end wall 10; a panel 14' defining rear wall 14; a panel 11' defining bottom end wall 11; and a panel 13" defining a bottom portion of front wall 13.

Each panel 13', 13", 14' has two lateral wings 12' and 12" located on opposite sides of panel 13', 13", 14' and separated from panel 13', 13", 14' by longitudinal crease lines 20. Panel 13' has a reinforcing flap 22; and each wing 12', 12" of panel 14' has rectangular longitudinal appendixes 23 located at opposite ends of wing 12', 12" and aligned longitudinally with each other.

When forming each packet 1, lateral wings 12' and lateral wings 12" are superimposed and glued to define minor lateral walls 12 of container 2; and each longitudinal appendix 23 is folded squarely with respect to relative lateral wing 12' or 12", and is superimposed on and glued to an inner surface of respective panel 10' or 11' to define an inner portion of relative end wall 10 or 11 of packet 1.

Figure 3:
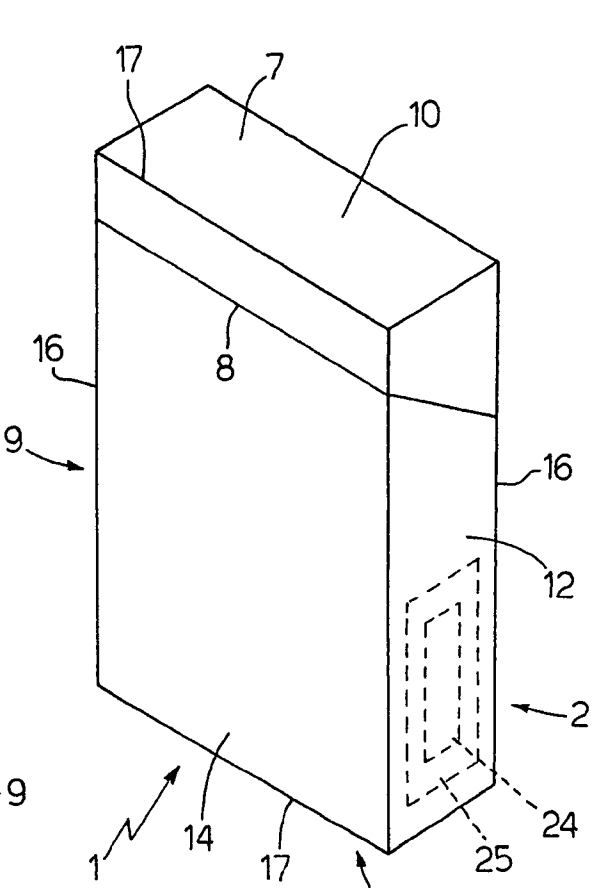
FIG. 3 shows a rear view in perspective of the FIG. 1 packet in the closed configuration and with a different marker location.
Figure 2:
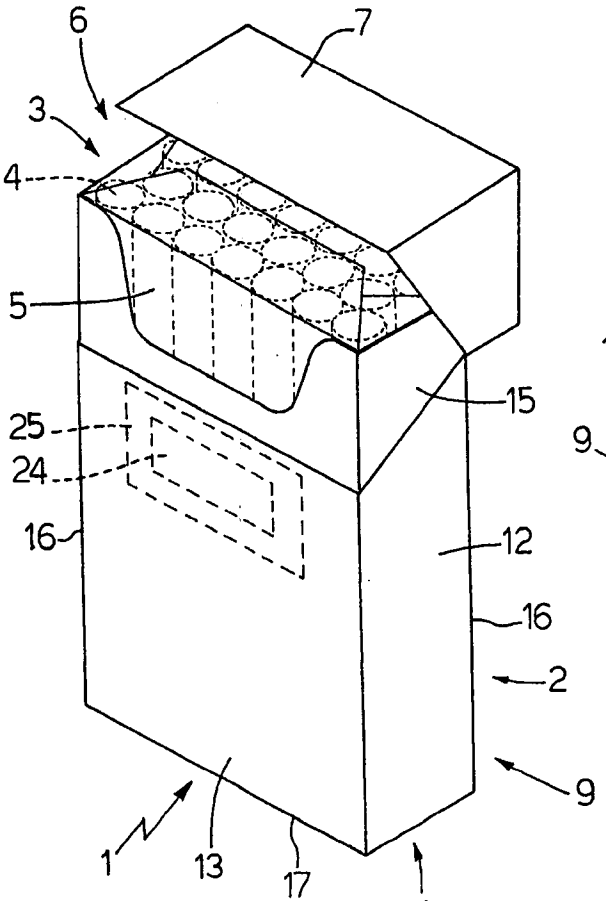
FIG. 2 shows a front view in perspective of the FIG. 1 packet in the open configuration and with a different marker location.

Packet 1 comprises at least one marker 24, which is housed inside container 2, in turn comprises resonating means resonating at a given resonance frequency, and is detectable at a distance of over 25 cm (typically at least 60–70 cm) by means of an electromagnetic field having a frequency substantially equal to the given resonance frequency. As shown in FIGS. 1, 2, 3, marker 24 is supported by a very thin label 25 made, for example, of plastic or paper material and housed inside container 2.

Label 25 may be positioned contacting the inner surface of bottom end wall 11 of container 2. Alternatively, label 25 may be positioned contacting the inner surface of a minor lateral wall 12 of container 2, or contacting the inner surface of a major lateral wall 13 or 14 of container 2. In alternative embodiments, label 25 may be glued to an inner surface of container 2, or to an outer surface of sheet 5 of foil wrapping material. Various positions in which label 25 may be glued are shown by the dash lines in FIG. 4.

Figure 5:
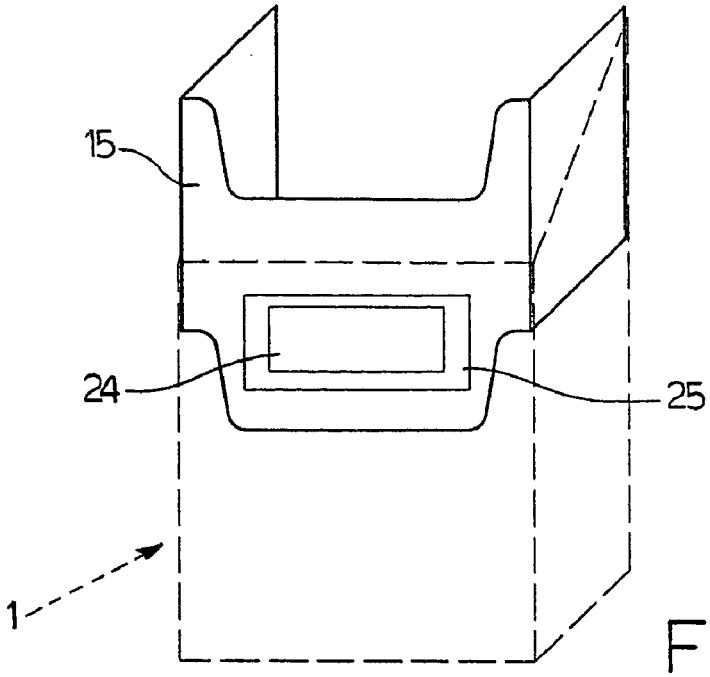
FIG. 5 shows a front view in perspective of a different embodiment of a packet of cigarettes in accordance with the present invention.

As shown in FIG. 5, label 25 is glued to a wall of collar 15, so as to be interposed between a wall of collar 15 and a wall of container 2.

The form of container 2 may obviously be varied, e.g. by rounding or bevelling longitudinal edges 16 and/or transverse edges 17; or container 2 may be other than parallelepiped-shaped, e.g. may have an ellipsoidal or triangular cross section.

Figure 6:
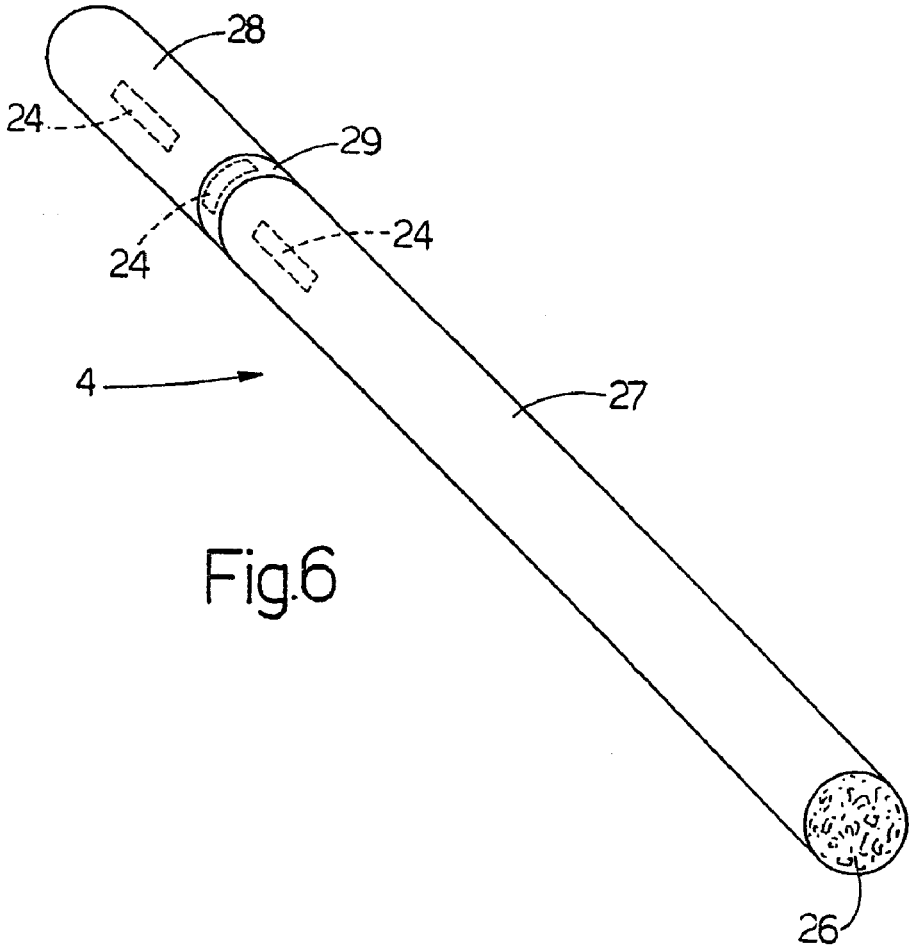
FIG. 6 shows a view in perspective of a cigarettes housed inside a further embodiment of a packet of cigarettes in accordance with the present invention.

As shown in FIG. 6, each cigarette 4 comprises a rod 26 of tobacco enclosed in a sheet 27 of wrapping material and connected at one end to a filter 28 by a connecting strip 29; and, as opposed to being fixed to container 2, marker 24 of packet 1 is incorporated in at least one of cigarettes 4 in group 3. More specifically, marker 24 may be housed inside filter 28 of cigarette 4, may be wound about filter 28 of cigarette 4, may be supported by connecting strip 29, or may be housed inside rod 26 of tobacco of cigarette 4.

In a first embodiment, marker 24 is defined by a magnetic marker, which, when activated, resonates acoustically when struck by a magnetic field at resonance frequency. For example, the marker may comprise a strip of magnetostrictive ferromagnetic material located adjacent to a ferromagnetic body, which, when magnetized, magnetically polarizes and acoustically activates the strip to resonate acoustically. Alternatively, the marker may comprise a number of superimposed sheets of magnetic material, each of which is polarized alternating north-pole magnetic alignments with south-pole magnetic alignments.

According to a preferred embodiment, marker 24 comprises a supporting element provided with three segments of magnetic material, which are spaced each others; each segment is an oriented magnetic dipole, which vibrates when struck by a magnetic field having a frequency in the acoustic sound-ultrasound range and emits energy in the form of a return magnetic field having a lower frequency. Marker 24 is disable when struck by a magnetic field, which changes the magnetic orientation of the segments.

In an alternative embodiment, marker 24 is defined by an electric circuit having inductors and capacitors, and which resonates when struck by an electromagnetic field at resonance frequency.

In a further embodiment, marker 24 is defined by a transponder having an antenna system receiving an electromagnetic field at resonance frequency.

Finally, marker 24 may be defined by one or more wires (for example of the type disclosed by WO-0153575-A1), each of which resonates when struck by a magnetic field at resonance frequency, and comprises a combination of textile fibres and fibres of amorphous magnetic material with weak ferromagnetic or magnetostrictive properties. The wires are extremely small (roughly 30 micron diameter), mechanically strong, fully pliable, and chemically resistant. Various types of textile fibres can be used, e.g. natural (cotton, wool), synthetic (polyester, polyamide, polypropylene, nylon) and semisynthetic. Recognition-function wires may be fitted with an enabling/disabling element for enabling or disabling remote recognition of the wires. Using wires is particularly advantageous when marker 24 is incorporated in a cigarette 4 as described above.

Effective remote detection of packet 1 of cigarettes described above is confirmed by various tests, which show marker 24 to be reader-detectable even at a distance of 1 meter. Moreover, marker 24 is so located as to be unrecognizable from the outside, or at any rate irremovable even if recognized. Finally, using a marker 24 activated substantially by magnetic fields makes it extremely difficult to shield packet 1 of cigarettes to prevent detection of marker 24.

Packet 1 of cigarettes as described above therefore provides for effectively preventing shoplifting from outlets equipped with devices for detecting markers 24.

The accompanying drawings show a rigid packet 1 of cigarettes comprising a rigid container 2 formed by folding a rigid sheet of packing material (blank 18) about group 3 of cigarettes 4. Alternatively, packet 1 of cigarettes may be a soft type comprising a soft container 2 formed by folding a sheet of soft wrapping material about group 3 of cigarettes 4; in which case, soft container 2 obviously has no lid 7 or collar 15.

Given the numerous advantages of packet 1 of cigarettes as described above, the form of packet 1 may also be extended-integrally to the production of a carton (rigid or soft) of packets of cigarettes, which is substantially identical to packet 1 as described above, the only difference being that it contains a group of packets of cigarettes, as opposed to a group of cigarettes.

The invention claimed is:

1. A package of tobacco articles, comprising:

a container (2) having an open top end (6);

a lid (7) hinged to the container (2) along a hinge (8) to rotate, with respect to the container (2), between an open position and a closed position respectively opening and closing the open top end (6);

a collar (15), which is folded into a U, is connected inside the container (2), and projects partly outwards of the open top end (6) to engage a corresponding inner surface of the lid (7) when the lid is in the closed position;

a group (3) of tobacco articles (4) housed inside the container (2);

at least one marker (24), which is housed inside the container (2), comprises magnetic resonating means resonating acoustically at a given resonance frequency, and is remotely detectable by a shoplifting detector device by means of a magnetic field having a frequency substantially equal to the resonance frequency; and a label (25) supporting the marker (24) and interposed between a wall of the collar (15) and a wall of the container (2).

2. A package as claimed in claim 1, wherein the label (25) is glued to an inner surface of the container (2).

3. A package as claimed in claim 1, wherein the label (25) is glued to a wall of the collar (15).

4. A package as claimed in claim 1, wherein the group of tobacco articles is defined by a group of packets of cigarettes.

5. A package as claimed in claim 1, wherein the group (3) of tobacco articles (4) is defined by a group (3) of cigarettes (4).

6. A package as claimed in claim 1, wherein the marker (24) comprises an enabling/disabling body fitted to the magnetic marker and for enabling and disabling the magnetic marker.

7. A package as claimed in claim 1, wherein the marker (24) comprises a supporting element provided with a number of segments of magnetic material, which are spaced from each other.

8. A package as claimed in claim 7, wherein each segment is an oriented magnetic dipole, which vibrates when struck by a magnetic field having a frequency in the acoustic sound-ultrasound range and emits energy in the form of a return magnetic field having a lower frequency.

9. A package as claimed in claim 8, wherein the marker (24) is disabled when struck by a magnetic field, which changes the magnetic orientation of the segments.

10. A package as claimed in claim 7, wherein the marker (24) comprises a supporting element provided with three segments of magnetic material, which are spaced from each other.

* * * * *